US009488404B2

(12) United States Patent
Smith et al.

(10) Patent No.: US 9,488,404 B2
(45) Date of Patent: Nov. 8, 2016

(54) FROST REDUCTION BY ACTIVE CIRCULATION

(75) Inventors: Dennis H. Smith, Dubuque, IA (US); Todd Swift, Weaverville, NC (US); Kevin D. Bramlett, Mars Hill, NC (US); Santosh Nerur, Asheville, NC (US); Walter Jeff Tipton, Asheville, NC (US); Wendell Morris, Asheville, NC (US)

(73) Assignee: Thermo Fisher Scientific (Asheville) LLC, Asheville, NC (US)

( * ) Notice: Subject to any disclaimer, the term of this patent is extended or adjusted under 35 U.S.C. 154(b) by 424 days.

(21) Appl. No.: 12/570,194

(22) Filed: Sep. 30, 2009

(65) Prior Publication Data

US 2010/0077775 A1 Apr. 1, 2010

Related U.S. Application Data

(60) Provisional application No. 61/101,581, filed on Sep. 30, 2008.

(51) Int. Cl.

*F25D 21/00* (2006.01)
*F25D 17/04* (2006.01)
*F25D 21/02* (2006.01)
(Continued)

(52) U.S. Cl.

CPC ..... *F25D 17/047* (2013.01); *F25D 17/042* (2013.01); *F25D 21/025* (2013.01); *F25D 21/04* (2013.01); *F24F 2003/144* (2013.01); *F25D 2201/14* (2013.01); *F25D 2317/043* (2013.01);
(Continued)

(58) Field of Classification Search

CPC ..... F25D 2317/0411; F25D 2317/04111; F25D 17/047; F25D 21/025; F25D 21/04; F25D 2317/043; F25D 2201/147; F25B 2700/02; F24F 2003/144

USPC ..... 62/3.6, 80, 92, 93, 94, 275, 150, 176.2, 62/3.4

See application file for complete search history.

(56) References Cited

U.S. PATENT DOCUMENTS 2,604,760 A 7/1952 Southern
4,513,579 A * 4/1985 Andersson et al. ..... 62/176.2
(Continued)

FOREIGN PATENT DOCUMENTS

CN 1595024 A 3/2005
DE 196 28 278 A1 11/1997
(Continued)

OTHER PUBLICATIONS

European Patent Office, International Search Report and Written Opinion of the International Searching Authority, International Application No. PCT/US2009/058980, mailed Sep. 7, 2010 (14 pages).
(Continued)

*Primary Examiner* — Marc Norman
*Assistant Examiner* — David Teitelbaum
(74) *Attorney, Agent, or Firm* — Wood Herron & Evans LLP

(57) ABSTRACT

An ultra low temperature refrigeration system and technique, includes a cabinet with a storage chamber maintained at a certain temperature range, a door providing a seal with the cabinet when engaged with the cabinet, and a dehumidifying unit connected to the cabinet for dehumidifying the storage chamber within the cabinet.

7 Claims, 4 Drawing Sheets

(51) Int. Cl.
*F25D 21/04* (2006.01)
*F24F 3/14* (2006.01)

(52) U.S. Cl.
CPC ..... *F25D 2317/0411* (2013.01); *F25D 2317/04111* (2013.01)

(56) References Cited

U.S. PATENT DOCUMENTS

| | | | | |
|---|---|---|---|---|
| 4,586,342 | A * | 5/1986 | Morishita et al. | 62/3.4 |
| 6,128,914 | A * | 10/2000 | Tamaoki et al. | 62/440 |
| 6,374,620 | B1 * | 4/2002 | Markey | 62/89 |
| 6,397,620 | B1 * | 6/2002 | Kelly et al. | 62/440 |
| 6,631,625 | B1 | 10/2003 | Weng | |
| 6,672,096 | B2 * | 1/2004 | Lopes | 62/331 |
| 6,990,819 | B2 | 1/2006 | Darling | |
| 7,107,780 | B2 * | 9/2006 | Bellini et al. | 62/273 |

FOREIGN PATENT DOCUMENTS

| | | | |
|---|---|---|---|
| DK | 171122 | B1 | 6/1996 |
| JP | 5-157443 | A | 6/1993 |
| WO | 83/01293 | A1 | 4/1983 |

OTHER PUBLICATIONS

Chinese Patent Office, Office Action and Search Report, Chinese PCT National Phase Patent Application No. 200980138733.9, dated Oct. 19, 2012 (5 pages).

Chinese Patent Office, English Translation of Office Action and Search Report, Chinese PCT National Phase Patent Application No. 200980138733.9, dated Oct. 19, 2012 (4 pages).

ESPACENET, English Machine Translation of Abstract for Application No. CN1595024A, retrieved from http://worldwide.espacenet.com on Dec. 3, 2012 (1 page).

* cited by examiner

FROST REDUCTION BY ACTIVE CIRCULATION

The present application claims the filing benefit of U.S. Provisional Application Ser. No. 61/101,581, filed Sep. 30, 2008, the disclosure of which is incorporated herein by reference in its entirety.

FIELD OF THE INVENTION

The present invention relates generally to a method and system of frost reduction in freezers. More particularly, the present invention relates to a system and method of reducing frost in ultralow temperature freezers by active circulation.

BACKGROUND OF THE INVENTION

There has been a rapid increased demand for refrigeration systems that can attain a very low temperature range. One type of system that CaO reach such temperatures is called an ultra low refrigeration system or called an ultra low freezer, which can maintain a very low range of temperatures. The ultra low temperature refrigeration systems can be used to store and protect a variety of objects including critical biological samples so that they are safely and securely stored for extended periods of time. However, with the low storage temperatures involved and the need to periodically insert and remove particular samples from the freezer compartment, various problems may arise.

Generally, in refrigeration systems, a refrigerant gas is compressed in a compressor unit. Heat generated by the compression is then removed generally by passing the compressed gas through a water or air cooled condenser coil. The cooled, condensed gas is then allowed to rapidly expand into an evaporating coil surrounding a refrigerator or freezer compartment where the gas becomes much colder, thus cooling the coil and the compartment of the refrigeration system or freezer around which the coil is placed.

Ultra-low and cryogenic temperatures ranging from approximately −95 degrees Celsius to −150 degrees Celsius have been achieved and even as low as −160 degrees Celsius. Examples of Ultra low temperature refrigeration systems are shown, for example, in U.S. Pat. No. 6,631,625 for Non-HCFC Refrigerant Mixture For An Ultra-Low Temperature Refrigeration System and U.S. Pat. No. 6,990,819 for Dryer System For The Prevention Of Frost in An Ultra Low Temperature Freezer. U.S. Pat. Nos. 6,631,625 and 6,990,819 are now hereby incorporated by reference.

During normal operation, freezers accumulate frost as a result of humid air entering the freezer. This problem is especially critical in ultra-low temperature freezer as the samples stored in such freezers can be particularly sensitive to changes in the environment within the freezer. This is even more a problem when there is a large temperature variation. The frost that is developed, even in the smallest amounts, can affect the environment of some or all of the individual samples within the freezer compartment and, therefore, contribute to serious problems. There is a need for having greater control of the environment within such a freezer, especially a control of the frost conditions that can develop with everyday use of such a freezer.

SUMMARY OF THE INVENTION

The foregoing needs are met, to a great extent, by the present invention, wherein, in one aspect, an apparatus and technique is provided for reducing the accumulation of frost in the sample compartment of the freezer apparatus.

In accordance with one aspect of the invention, an ultra low temperature freezer apparatus includes a cabinet with a storage chamber maintained at a certain temperature range, a door providing a seal with the cabinet when engaged with the cabinet, and a dehumidifying unit connected to the cabinet in a closed loop, configured to actively dehumidify the storage chamber by circulating air out of the compartment and returning dehumidified air to the compartment.

The dehumidifying unit can also contribute to lowering of the temperature within the freezer sample compartment. A refrigeration unit connected to the cabinet can provide primary cooling of the freezer compartment to maintain the compartment within the certain temperature range. The dehumidifying unit and the refrigeration unit can also each contribute to the dehumidification of the freezer compartment. A controller can manage the dehumidifying unit.

A pressure equalization valve can be connected to the dehumidifying unit for receiving air from outside the freezer compartment and passing the air to the dehumidifying unit after the door has been opened and reclosed. The dehumidifying unit can remove moisture from the exterior air before passing the dehumidified air into the freezer compartment.

A fan or blower fluidly connected to or in the dehumidifying unit can provide a convection current within the cabinet at various times when the door is closed and freezer compartment is sealed, and can be cycled off when the door is open so as to unseal the freezer compartment.

This disclosure describes certain embodiments of the invention in order that the detailed description may be better understood, and in order that the present contribution to the art may be better appreciated. Additional embodiments of the invention are described below or will be apparent from this description to one skilled in the art and do not limit the subject matter of the invention as set forth in the claims.

The invention includes embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE INVENTION

Figure 1:
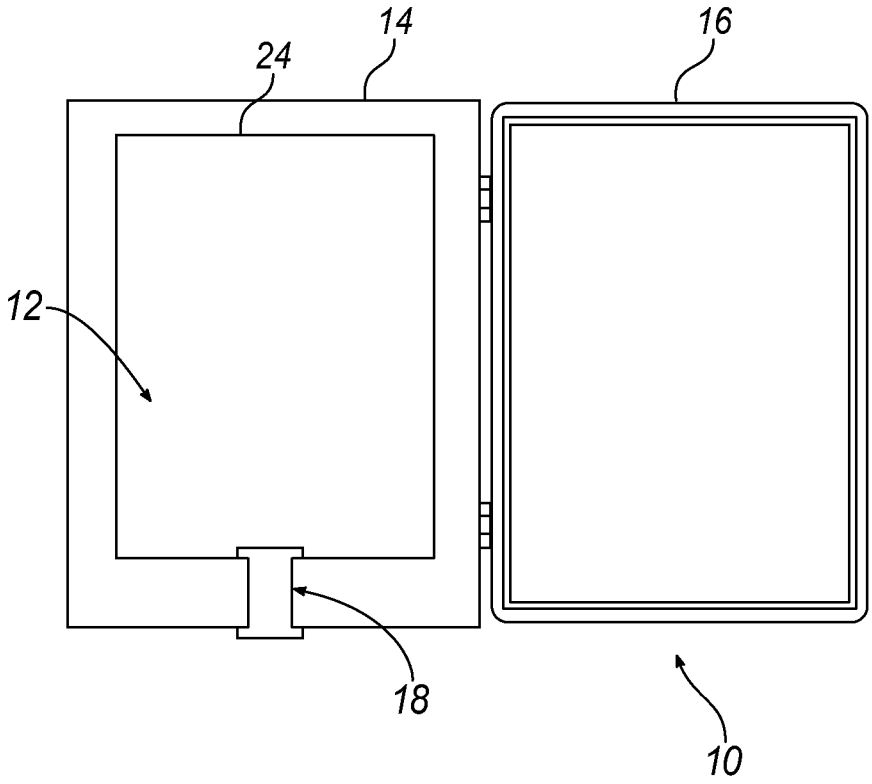
FIG. 1 illustrates one embodiment of a freezer according to the present invention with an open door.

The invention will now be described with reference to the figures, in which like reference numerals refer to like parts throughout.

Frost accumulates during routine operation of ultra-low temperature freezers through humid air entering the freezer. Sources for air entry in the freezers are, for example, a door opening to remove and/or replace experiment samples. Humid air can also enter through a faulty seal in the storage chamber of the freezer or in the door that seals the chamber. Humid air can also enter, as described below, during the pressure equalization process that occurs after the door is resealed if warmer (less dense) air has entered the freezer compartment while the door was open.

As seen in FIG. 1, the ultra low temperature freezer 10 can include an outer frame 14, with a cabinet 24 providing a storage chamber or freezer compartment 12 to contain materials being cooled and maintained at low temperatures in a desired range (e.g., −95° C. to −150° C. or −80° C. to −160° C. for biological laboratory samples). The freezer 10 also includes a door 16 that is attached to the frame 14 and provides a seal of the cabinet 24 when closed. FIG. 1 shows the door 16 in the open position, in which humid air can be transferred from outside of the freezer 10 into the compartment 12.

Pressure equalization between the freezer interior and atmospheric conditions is an important source for entry of humid air. A pressure equalization port (PEP) valve 18 (as shown in FIG. 1 and found in most freezers) opens to admit external air after the door has been reclosed and the refrigeration system has begun cooling the air from a temporarily elevated temperature back towards the desired temperature range. If no PEP is present, leaks in the seal or gasket will usually be sufficient to allow entry of humid air from outside of the cabinet 24 in response to a sub-atmospheric pressure being created inside the cabinet as the interior air is re-cooled to the desired temperature range.

Over a period of time, especially as the freezer door is opened to insert new samples or remove samples, frost will build up due to condensation of humidity from the admitted air onto surfaces of the freezer compartment and surfaces of the samples. Such frost that is built up in the freezer 10 can impede operation and may have to be removed by the user. Removal of the frost can be performed by defrosting the freezer in various systematic ways or manually removing the frost away from the freezer 10. However, both defrosting and manual removal are difficult to accomplish with an ultra low freezer and may require temporary removal of the samples from the freezer compartment to avoid adverse effects upon the samples. Manual frost removal requires time and expertise by the user and can create a risk of damaging the freezer structure 10 and can also be cumbersome to perform. Any automated defrosting method will also require time and there is a danger of affecting the materials stored in the freezer 10 within the freezer compartment 12.

The sample materials in the freezer 10 may even have to be removed in order to avoid sample contamination during defrosting or affect the internal environment of the freezer 10. If, for example, the material stored in the freezer 10 is a frozen biological material highly sensitive to humidity, steps could be required to prevent the stored samples from being adversely affected. Therefore, for defrosting, an empty ultra low freezer 10 is often required so that the stored samples or other materials are not allowed to defrost. Additionally, removal of materials being stored can add to the cost of storage because of the added labor involved. Additionally, there is strict governmental regulatory control of certain samples and materials. There is even a danger of the storage materials, or samples, being damaged or harmed otherwise, by a temporary transfer of the samples. Additionally, if a sample treatment process requires long periods of controlled storage, that process could be hindered by a cessation or gap in time in the process.

According to one embodiment, the formation of frost in the freezer compartment of an ultra low freezer is prevented by re-circulating the interior air through an external closed-loop dehumidification process. The returning air would contain less moisture than the interior air removed from the compartment and would typically also be at a lower temperature. Such lower temperature air could also increase the cooling capacity of the entire freezer 10 and in turn improve temperature recovery from door 16 opening as well as contribute to the maintenance of temperature uniformity inside the freezer compartment 12.

Moreover, the removal of moisture from the air inside the freezer compartment on a continual and active basis can reduce the amount of frost that builds up within the freezer compartment 12 and extend the time span between defrost cycles or user removal of frost build-up or even extend the timing of such cycles to coincide with freezer maintenance events. The amount of moisture that would be required to be removed could be dependent upon factors such as the humidity ratio of the ambient air compared to the freezer chamber air, the frequency of door openings by the user, and the air tight integrity of the cabinet.

Figure 2:
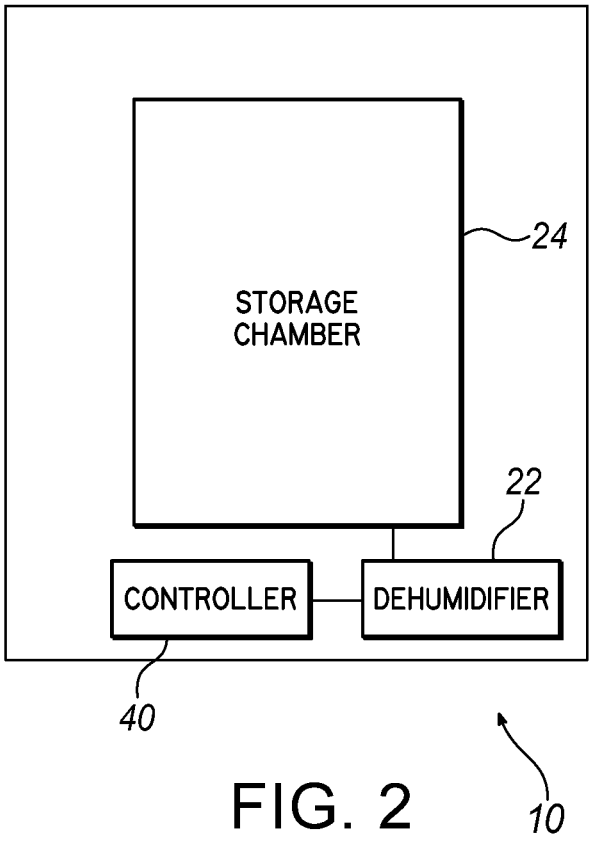
FIG. 2 is a block diagram of the freezer of FIG. 1 with an active dehumidifier.
Figure 3:
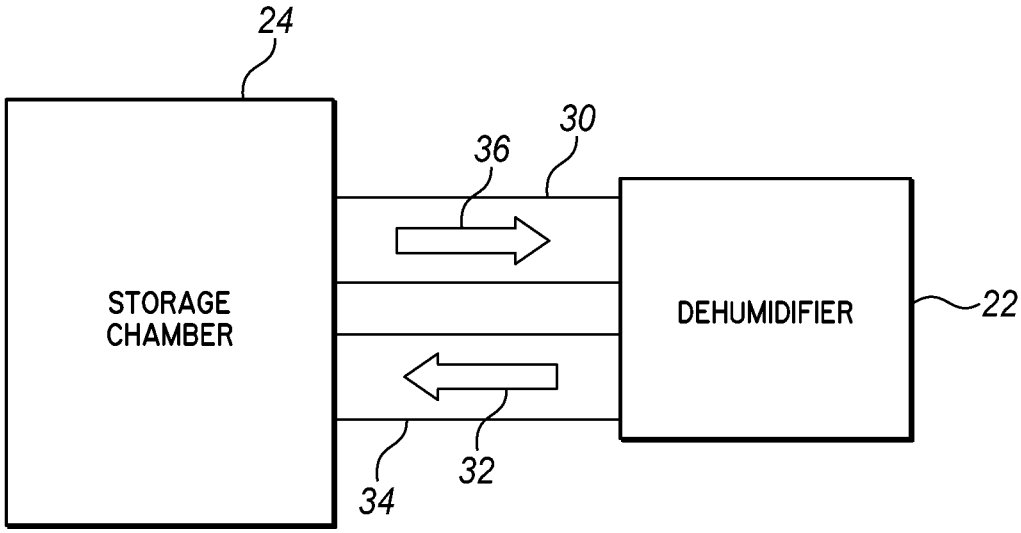
FIG. 3 is a block diagram of the freezer of FIG. 1, showing active dehumidification of the freezer compartment or storage chamber with a separate dehumidifier.

Referring to FIGS. 2 and 3, the freezer 10 according to one embodiment includes a dehumidifier 22 that can be located within the freezer housing 14 (see FIG. 1 also). The dehumidifier 22 can also be located in any location in the freezer housing 14 or even outside of the freezer 10 itself. The air or gas within the inner compartment or storage chamber 12 of the cabinet 24 has, in most embodiments of the present invention, a direct or indirect fluid connection to the dehumidifier 22 so that the gas or air within the compartment 12 can be withdrawn from the chamber and passed through the dehumidifier 22. Using a dehumidifier in that manner and then returning the dehumidified air to the freezer compartment is sometimes referred to in this disclosure as dehumidifying in an active manner.

Referring now to FIG. 3, the freezer compartment 12 within the cabinet 24 of the freezer 10 can be maintained at a normal set temperature of about −80 degrees Celsius. The primary mode of maintaining the set temperature is provided by the refrigeration unit 50 (shown in FIG. 5). The dehumidifier 22 can provide a secondary means for lowering the temperature of the freezer compartment within the cabinet 24. In one embodiment, the dehumidifier 22 is configured to circulate air from the freezer compartment 12 and back to the freezer compartment, while dehumidifying it through a dehumidification process. The dehumidifier 22 can alternatively include any type of device that is capable of reducing the degree of wetness within the atmosphere of the cabinet 24. Air or gas at or just above the set temperature (−80 degrees Celsius) is directed through fluid conduit 30 to the dehumidifier 22 in the direction of the arrow 36. After dehumidification (and, typically, cooling to below the set temperature), air is directed back to the cabinet 24. Depending upon the type and configuration of dehumidifier used, temperatures as low as, for example, about −190 degrees Celsius (with especially dry air) can be returned through a second fluid conduit 34 in the direction of arrow 32. The returned air can be at any temperature lower than the freezer compartment 12 temperature. The two fluid conduits 30 and 34 can be a variety of configurations including a plurality of connection sub-parts or there can be an integration of the connection parts 30 and 34 in forms such as concentric circles.

The dehumidifier 22, and/or one or both of the fluid conduits 30 and 34, may include a fan, blower or other suitable forced air device for moving air between the storage chamber 12 and the dehumidifier 22.

Figure 3A:
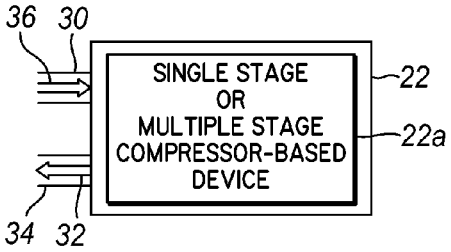
FIGS. 3A-3D are diagrammatic views of various embodiments of the dehumidifier shown in FIG. 3.
Figure 3C:
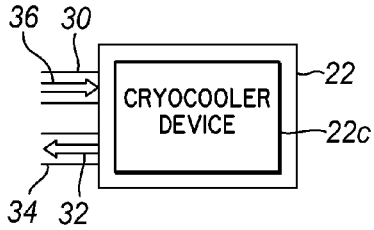
Figure 3B:
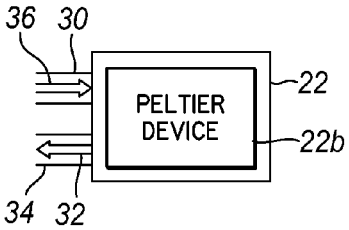
Figure 3D:
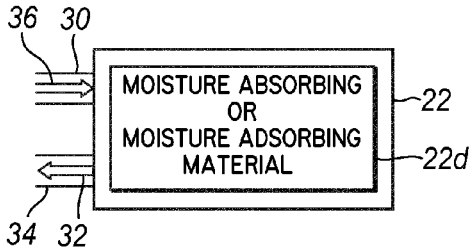

The dehumidifier 22 can be a single stage or multiple stage device 22*a* as shown in FIG. 3A. The dehumidifier 22 can include a cooling feature that reduces the temperature of the air coming from the freezer compartment 12 well below the set temperature as a means for achieving dehumidification as shown in FIGS. 3A-C. Other types of dehumidifiers can employ, for example, moisture absorbing particles or moisture adsorbing particles 22*d* as shown in FIG. 3D.

As seen in FIG. 3, a closed loop dehumidification process is performed. The returning air through fluid conduit 34 would be also at a lower temperature than air received through fluid conduit 30. The cooling capacity would thereby be increased for the entire freezer 10. The uniformity of the temperature can also be increased within the interior compartment or storage chamber of the cabinet 24 because of the circulation of air caused by withdrawal through conduit 30 and re-entry through conduit 34.

The control of the dehumidification process can be controlled through a computer or controller 40. The controller 40 can be programmed with software stored in a memory unit to maintain and control the dehumidifier 22, based upon sensors (not shown) of the temperature, humidity and/or pressure within the freezer compartment 12.

The dehumidifier 22 can be controlled to maintain a certain temperature and humidity level of air in the freezer chamber 12 within compartment 24 through a variable control. Alternatively, the dehumidifier 22 and fans or other structures used to flow air through conduits 30 and 34 can be set to cycle on and off in a programmed fashion in response to door opening events or to sensed temperature, pressure or humidity. The dehumidifier 22 can also be manually adjusted directly or through the controller 40 to achieve particular humidity levels appropriate for certain types of samples.

Figure 5:
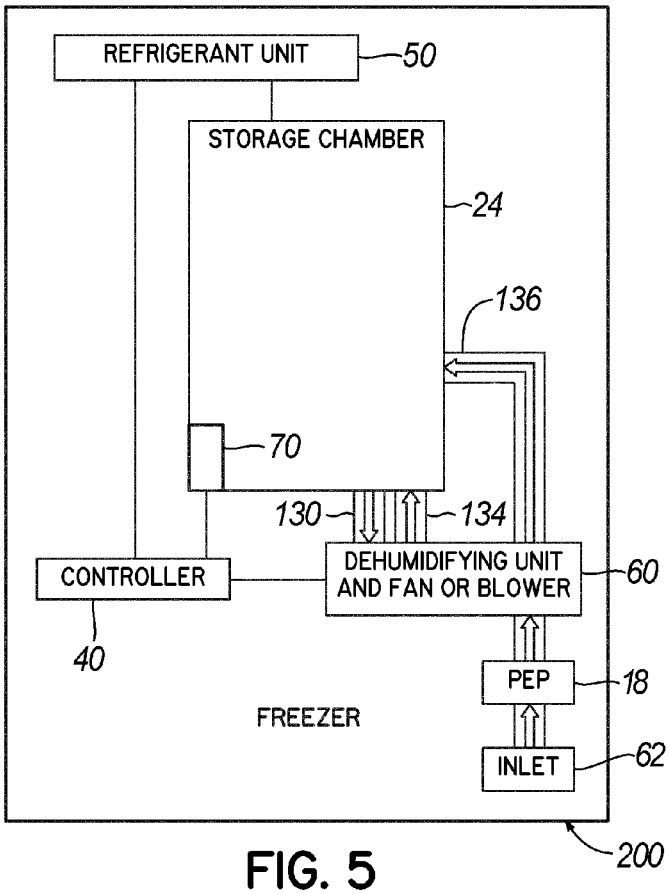
FIG. 5 is a block diagram of a freezer according to a second embodiment of the present invention, with an alternative dehumidifying device connected both to the storage chamber and to a pressure equalization port (PEP) device.

The dehumidifier 22 can be set to control the moisture and temperature through sensors 70 (as seen in FIG. 5) within the freezer compartment 12 within cabinet 24 or preset according to a predetermined set of instructions. The closed loop flow can be maintained by having conduits 30 and 34 pass directly through the cabinet 24 or indirectly with the cabinet through a secondary compartment adjacent or coupled through the cabinet 24, so that the flow of air or other type of gas can be controlled in temperature and humidity level.

The humidity level can be set to a predetermined level or to a level increasing as close to zero humidity as possible or within a range of humidity levels. The humidity level can be sensed through the sensor 70 in the chamber 24 (shown in FIG. 5), and the dehumidifier 22 and any associated fan or blower can be set to operate for certain durations of time on a periodic basis or in response to door opening events to reduce the humidity and temperature.

Figure 4:
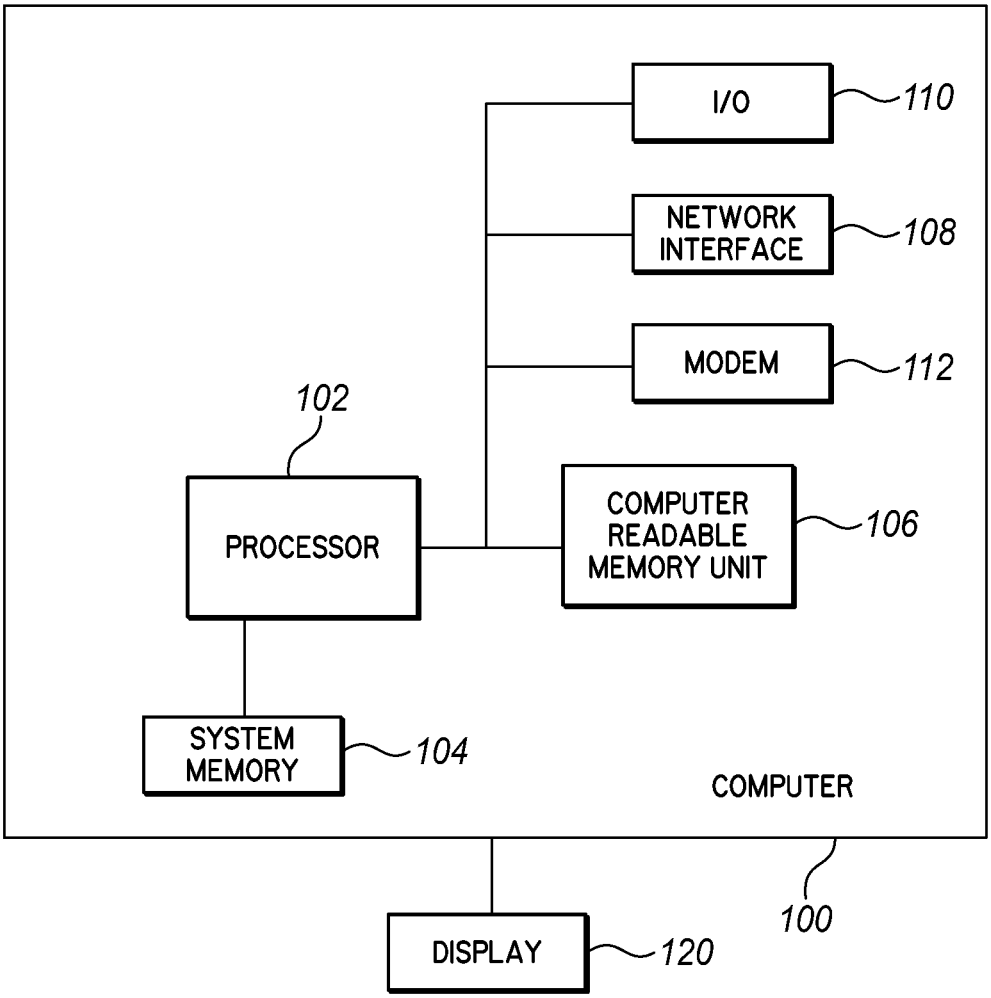
FIG. 4 is a functional block diagram of a computer that can run the computer executable instructions of the present invention as an alternative to the controller of FIG. 2.

The present disclosure can be realized as computer-executable instructions in computer-readable media executable by the controller 40 or alternatively computer 100 as seen in FIG. 4. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), re-writable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The invention can include the computer-readable medium having stored thereon a data structure including a plurality of fields containing data representing the techniques of the invention.

Referring to FIG. 4, an example of a computer, but not limited to this example of the computer 100 as an alternative to controller 40 or in addition to controller 40, that can read computer readable media that includes computer-executable instructions of the invention. The computer 100 includes a processor 102 that uses the system memory 104 and a computer readable memory device 806 that includes certain computer readable recording media. A system bus connects the processor 102 to a network interface 108, modem 112 or other interface that accommodates a connection to another computer or network such as the Internet. The system bus may also include an input and output (I/O) interface 110 that accommodate connection to a variety of other devices. Furthermore, the computer 100 can output through, for example, the I/O 110, data for display on a display device 120.

FIG. 5 illustrates a second embodiment of freezer 200 wherein the dehumidifier 60 may be connected by fluid conduits both to the freezer compartment and to the PEP device 18. The dehumidifier 60 in freezer 200 can be a variety of types of dehumidifiers including, for example, a compressor based dehumidifier. The compressor based dehumidifier 60 draws air via a fluid conduit 130 in from the storage chamber of the cabinet 24 to remove the moisture from the air entering the dehumidifier 60. However, the air is not reheated to room temperature, but rather is directed out of the dehumidifier 60 and back into the freezer compartment 12 via fluid conduit 134 at a lower temperature than the air received through the fluid conduit 130. Thereby, the air that is sent back into the storage chamber of the cabinet 24 has reduced moisture and has a lower temperature than the air or other type of gas mixture that taken in through fluid conduit 130.

In this embodiment, the dehumidifier 60, and/or one or both of the fluid conduits 130 and 134, may include a fan, blower or other suitable forced air device as shown diagrammatically in FIG. 5.

As an alternative to the compressor based dehumidifier, the dehumidifier 60 can be a peltier dehumidifier that is used in conjunction with the refrigeration unit 50 of the freezer 200 as shown in FIG. 3B. A peltier dehumidifier can use a cold metal surface to condensate the air on it. The peltier dehumidifier is more limited in terms of refrigeration temperatures than a compressor based dehumidifier and therefore, the primary refrigeration unit 50 of the freezer 200 can be used in conjunction with one or a plurality of peltier dehumidifiers. The existing refrigeration system 50 used in conjunction with peltier type coolers for the dehumidifier 60 can obtain a lower dew point than −180 degrees Celsius, so one can get a change of about 30 degrees cooler or more and dehumidify the air down.

The dehumidifier 60 can increase the overall power that is used by the unit, but the power used is compensated by the lower temperature and the control of the frost obtained. Additionally, the controller 40 can be used to balance the power used by the dehumidifier 60 and the primary refrigeration unit 50 of the freezer 200, so that the lowered temperature is compensated by the power being consumed by the refrigeration unit 50 and the dehumidifier 60.

Referring again to FIG. 5, the freezer 200 can also be connected via a fluid conduit 136 to the dehumidifier 60 so as to be in fluid communication with the inlet side of the PEP device 18. In this particular embodiment, a separate fluid connection of the dehumidifier 60 with the storage chamber through fluid conduits 130 and 134 is optional. Additionally, in this particular embodiment, the inclusion of a fan, blower or other suitable forced air device is also optional.

The function of the PEP device 18 is to replace −80 degrees Celsius air, created by the vacuum in the cabinet 24 which occurs upon re-cooling of air in the freezer compartment from a temporarily elevated temperature (above −80 degrees Celsius in the example) by primary refrigeration unit 50. In a normal freezer, PEP valve 18 allows small amounts of warm moist air to enter the freezer compartment. To the extent that warm moist air is admitted to the closed system in the present invention, it is preferred to occur at the inlet side of the dehumidifier 60, so as to fully cool and dehumidify that air before it can enter the freezer compartment. The air from outside of the freezer 200 can enter through the inlet 62 and then pass through the PEP device 18 to the dehumidifier 60. The dehumidifier 60 can remove the moisture from the air before it enters the storage chamber 12 through fluid conduit 136.

The operation of such embodiments illustrates the method of the present invention, in which moisture is removed from the air in the freezer compartment by dehumidification, and/or moisture from air entering the freezer compartment from outside the compartment is removed by dehumidification. In most instances, dehumidification is sufficient to prevent frost from forming. But, to the extent that small amounts of frost do form, the humidity of the air returning from the dehumidifier, especially when operated at extremely low temperatures such as −190 C., may result in slow sublimation of the water content from the frost areas back into the air. The storage chamber 24 or cabinet can also be modified further in order to take advantage of the convection that is created from the fan or blower within the dehumidifier 60 or conduits 130 or 134, if present, that is moving the air. The convection or moving of the air via the fan or blower may be configured to also enhance uniformity of the air conditions with the storage chamber of the freezer compartment within cabinet 24 using chamber designs and/or storage rack arrangements that take advantage of the positions in which air is drawn into conduit 30 and returned in conduit 34.

For the dehumidifier 60, different technologies can be used as alternatives, such as the cryocooler 22*c* as the dehumidifying unit 60 as shown in FIG. 3C. Cryocoolers are devices that can reach cryogenic temperatures and can use helium cold finger with helium as refrigerant as an alternative to a dehumidifier 22 of FIG. 3. Other types of devices that can reduce at least the humidity and additionally the temperature can also be used as an alternative to or in addition to the examples mentioned. The refrigeration system 50 of freezer 200 can be managed by the controller 40.

Since there may be a limited contact time for air within the dehumidification device when the fan is on, and therefore some limits in the amounts of moisture that is pulled, the heat exchanger part within the dehumidifier can be further optimized for those parts and can be insulated. The dehumidifier 60 itself and/or the fan or blower drawing air to it can be on all the time or cycled at certain intervals or controlled according certain sensors 70 within the storage chamber of the cabinet 24. The dehumidifier 60 can be in an on state all the time and have the fan or blower, circulating the air, being cycled off when the door opened, and have the fan cycled on when the door is closed. The fan or blower being off may limit the convection (and thus reduce warm moist air entry) when the door 16 opened. In general, and especially when attached to the PEP device, the dehumidifier is likely to be operating most continuously and needed most after the door has been closed when the air inside the freezer compartment is being cooled back down to the set temperature (and vacuum, if any, is being created).

The algorithm used by the controller 40 can be used in conjunction with the convection of air produced by the dehumidifier 60. Therefore, the controller 40 can take into account the convection by the dehumidifier 60 and the refrigeration system 50 of the freezer 200.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A refrigeration apparatus, comprising:

a cabinet having a freezer compartment maintained within a predetermined temperature range by a refrigeration unit;

a door to seal the cabinet when engaged with the cabinet;

a pressure equalization valve that receives ambient air from outside of the freezer compartment in response to a vacuum created in the freezer compartment; and a dehumidifying unit fluidly connected to the freezer compartment so as to circulate interior air from the freezer compartment through the dehumidifying unit and back to the freezer compartment, the dehumidifying unit being directly connected to the pressure equalization valve, the dehumidifying unit being located entirely downstream of the pressure equalization valve, such that the ambient air flowing through the pressure equalization valve flows directly to the dehumidifying unit, the dehumidifying unit actively dehumidifying the interior air within the freezer compartment as the interior air is circulated from the freezer compartment through the dehumidifying unit and back to the freezer compartment, the dehumidifying unit dehumidifying the ambient air received by the pressure equalization valve and directly passing dehumidified ambient air from the dehumidifying unit into the freezer compartment.

2. The apparatus of claim 1, further comprising a forced air device fluidly connected to the dehumidifying unit.

3. The apparatus of claim 1, wherein the dehumidifying unit comprises one of a single stage compressor-based device, a multiple stage compressor-based device, a peltier device, a cryocooler device, a moisture absorbing material or a moisture adsorbing material.

4. A method of dehumidifying a freezer compartment of a refrigeration apparatus using a dehumidifying unit fluidly located entirely downstream of a pressure equalization valve, wherein the dehumidifying unit is fluidly connected to the freezer compartment and the pressure equalization valve, comprising the steps of:

circulating interior air from the freezer compartment through the dehumidifying unit and back to the freezer compartment;

drawing ambient air from outside the freezer compartment into the pressure equalization valve in response to a vacuum created in the freezer compartment;

passing the ambient air from the pressure equalization valve directly to the dehumidifying unit in response to the vacuum created in the freezer compartment;

removing moisture from the ambient air with the dehumidifying unit to provide ambient dehumidified air;

passing the ambient dehumidified air from the dehumidifying unit into the freezer compartment;

drawing interior air from the freezer compartment into the dehumidifying unit as the interior air is circulated from the freezer compartment through the dehumidifying unit and back to the freezer compartment by the dehumidifying unit;

removing moisture from the interior air with the dehumidifying unit to provide interior dehumidified air; and passing the interior dehumidified air from the dehumidifying unit into the freezer compartment.

5. The method of claim 4, further comprising the step of recirculating the interior air through the dehumidifying unit.

6. The method of 5, wherein the recirculating step is continuous.

7. The method of claim 5, wherein the recirculating step is intermittent.

* * * * *